US010745843B2

(12) United States Patent
Xu et al.

(10) Patent No.: US 10,745,843 B2
(45) Date of Patent: Aug. 18, 2020

(54) DRUM WASHING MACHINE WITH INNER AND OUTER DOOR

(71) Applicant: QINGDAO HAIER DRUM WASHING MACHINE CO., LTD., Shandong (CN)

(72) Inventors: Sheng Xu, Shandong (CN); Yanfen Lv, Shandong (CN); Huacheng Song, Shandong (CN)

(73) Assignee: QINGDAO HAIER DRUM WASHING MACHINE CO., LTD., Qingdao, Shandong (CN)

( * ) Notice: Subject to any disclaimer, the term of this patent is extended or adjusted under 35 U.S.C. 154(b) by 113 days.

(21) Appl. No.: 16/064,329

(22) PCT Filed: Dec. 22, 2016

(86) PCT No.: PCT/CN2016/111418
§ 371 (c)(1),
(2) Date: Jun. 20, 2018

(87) PCT Pub. No.: WO2017/107940
PCT Pub. Date: Jun. 29, 2017

(65) Prior Publication Data

US 2019/0010650 A1 Jan. 10, 2019

(30) Foreign Application Priority Data

Dec. 23, 2015 (CN) ..... 2015 1 0980618

(51) Int. Cl.
*D06F 37/10* (2006.01)
*D06F 37/28* (2006.01)
*D06F 39/14* (2006.01)

(52) U.S. Cl.
CPC ..... *D06F 37/10* (2013.01); *D06F 37/28* (2013.01); *D06F 39/14* (2013.01)

(58) Field of Classification Search
CPC ..... D06F 37/10; D06F 37/28; D06F 39/14
See application file for complete search history.

(56) References Cited

U.S. PATENT DOCUMENTS

2013/0002113 A1 1/2013 Loss
2015/0292135 A1 10/2015 Wishney et al.
2018/0135231 A1* 5/2018 Park ..... D06F 37/266

FOREIGN PATENT DOCUMENTS

CN 2752302 Y 1/2006
CN 104963160 A 10/2015
(Continued)

OTHER PUBLICATIONS

International Search Report (PCT/ISA/210) dated Mar. 27, 2017, by the Chinese Patent Office as the International Searching Authority for International Application No. PCT/CN2016/111418.
(Continued)

*Primary Examiner* — Spencer E Bell
(74) *Attorney, Agent, or Firm* — Buchanan Ingersoll & Rooney PC

(57) ABSTRACT

A door at the front opening of a drum washing machine has an inner and outer double-layer structure. The inner door is hinged with the case of the washing machine to partially open/close the front opening. An opening is provided at an upper part of the inner door, and the outer door is hinged with the inner door to open/close the opening at the upper part of the inner door. The inner door and the outer door cooperate to fully open/close the front opening of the case. If the user wants to add laundry or detergent to the washing machine during the washing process, the water inside the washing machine does not need to be completely discharged before the door is open. Laundry or detergent can be added to the washing machine through the inner door upper part opening.

12 Claims, 7 Drawing Sheets

(56) References Cited

FOREIGN PATENT DOCUMENTS

| | | | |
|---|---|---|---|
| CN | 104975476 | A | 10/2015 |
| DE | 2244751 | A1 | 3/1974 |
| EP | 1389643 | A2 | 2/2004 |
| EP | 1 262 589 | B1 | 6/2006 |
| EP | 2 402 499 | A1 | 1/2012 |
| EP | 2 415 920 | A1 | 2/2012 |
| EP | 2 434 046 | A1 | 3/2012 |
| JP | 2012-011092 | A | 1/2012 |
| KR | 10-2009-0096948 | A | 9/2009 |
| KR | 101481518 | B1 | 1/2015 |
| KR | 10-2015-0118230 | A | 10/2015 |
| WO | WO 2011/063486 | A1 | 6/2011 |

OTHER PUBLICATIONS

Written Opinion (PCT/ISA/237) dated Mar. 27, 2017, by the Chinese Patent Office as the International Searching Authority for International Application No. PCT/CN2016/111418.

Extended European Search Report dated Dec. 3, 2018, issued by the European Patent Office in corresponding European Application No. 16877750.6. (7 pages).

Office Action (Notification of Reason for Refusal) dated Sep. 29, 2019, by the Korean Patent Office in corresponding Korean Patent Application No. 10-2018-7021136 and English translation of the Office Action. (9 pages).

Office Action (Notification of Reason for Refusal) dated Dec. 17, 2019, by the Japanese Patent Office in corresponding Japanese Patent Application No. 2018-532430 and English translation of the Office Action. (8 pages).

* cited by examiner

DRUM WASHING MACHINE WITH INNER AND OUTER DOOR

TECHNICAL FIELD

The present disclosure relates to the technical field of washing machine, especially a drum washing machine with a variety of door opening methods.

BACKGROUND

In an existing drum washing machine, a clothing inlet is arranged on a side of the drum washing machine and a door is provided at the clothing inlet. Before a washing, a user opens the door and puts the laundry into a drum, and the door closes the clothing inlet when the washing is performed. Since the washing drum filled with water during washing, or the laundry needs to be heated in the drum during drying, if the user wants to add laundry into the drum washing machine during its working, only when the water in the drum washing machine is drained, or when the internal temperature drops to the set temperature, then the door lock is open and the user can add laundry. It not only wastes time and water resources, but also brings great inconvenience to the user usage.

The present disclosure is proposed in view of foregoing.

SUMMARY

The objective of the present disclosure is to overcome the shortcomings of the prior art by providing a drum washing machine with a variety of door opening methods.

In order to achieve the objective, the present disclosure adopts the following technical solution: a drum washing machine and a door is installed at the front opening of the drum washing machine, and one side of the door is hinged with a case of the washing machine. The door is an inner and outer double-layer structure comprising an inner door and an outer door. The inner door is hinged with the case of the washing machine to partially open/close the front opening of the case. An opening is provided at an upper part of the inner door, and the outer door is hinged with the inner door to open/close the opening at the upper part of the inner door. The inner door and the outer door cooperate to fully open/close the front opening of the case.

An inner door glass window is provided at a lower part of the inner door, and an opening is provided at the upper part of the inner door. An outer door glass window is provided at an upper part of the outer door to open/close the inner door upper part opening. The inner door glass window and the outer door glass window cooperate to form an observation window.

The outer side of the outer door is provided with an outer door window screen, which is connected with the outer door glass window, to cover the outer door glass window and the inner door glass window.

A door lock structure is arranged between the inner door and the outer door, and the door lock structure can lock the outer door and the inner door into one part.

The inner door comprises an inner door inner frame, an inner door outer frame and an inner door glass window. The inner frame and the outer frame are annular frames. The inner door glass window at least covers the lower part of the area enclosed by an inner ring of the inner door inner frame and the inner door outer frame. The upper part of the enclosed area is an opening.

The outer profile of the inner door glass window is semi-circular, and the middle part protrudes towards the case. A turnup is provided at the edge of the lower arc section. The turnup is clamped between the inner door inner frame and the inner door outer frame.

The outer door comprises an outer door inner frame, an outer door outer frame, an outer door glass window, and an outer door window screen. The outer door inner frame and the outer door outer frame are annular frames, and the outer door glass window covers the upper part of the area enclosed by an inner ring of the outer door inner frame and the outer door outer frame.

The outer door glass window is a semi-circular transparent basin, and the end part is provided with a semi-circular opening. The opening faces the outer door outer frame or the outer door window screen, and a turnup is provided at the edge of the lower arc section. The turnup is clamped between the outer door inner frame and the outer door outer frame. The outer door window screen and the outer door outer frame are connected.

A hermetic structure is provided at the turnup of the upper part of the inner door glass window. The hermetic structure comprises a grooving type mounting seat wrapping the turnup of the upper part of the inner door glass window and an elastic sealing strip at the upper part of the mounting seat forming an angle with the top surface of the mounting seat.

A baffle is set between the inner door inner frame and the inner door outer frame, corresponding to the inner door glass window. The baffle and a protruded part of the inner door glass window form an accommodation chamber.

The inner door glass window is larger than a semi-circular surface, and the outer door glass window is smaller than a semi-circular surface.

A hinge of the inner door and the case is located at one side of the case, and a hinge of the inner door and the outer door is at the other side of the case, or the hinge of the inner door and the case and the hinge of the inner door and the outer door are at the same side of the case, or the hinge of the inner door and the case is at one side of the case and the hinge of the inner door and the outer door is at the lower side of the case.

After adopting the above technical solutions, the present disclosure has the following beneficial effects compared with the prior art: normally, the user can open the inner door to pick/place laundry from/in the washing machine. If the user wants to add laundry or detergent to the washing machine during the washing process, the water inside the washing machine did not need to be completely discharged before the door is open. Just open the outer door and add laundry or detergent to the washing machine through the inner door upper part opening. Moreover, the inner door and the outer door are connected with each other in a reliable manner. Observed from the outside, the door is a whole unit, which gives the user a good overall feeling and provides a variety of ways to open the door.

The embodiments of the present disclosure are described in further detail below with reference to the accompanying drawings.

Figure 1:
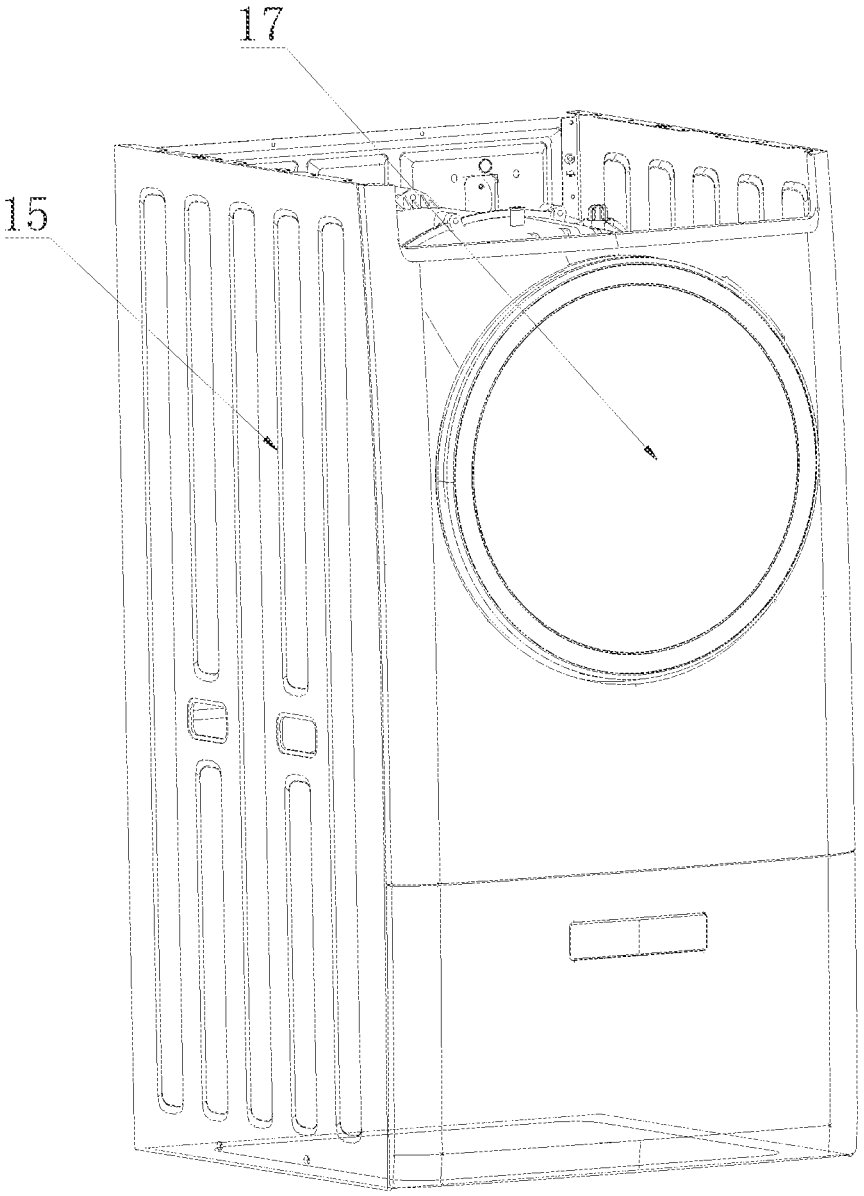
FIG. 1 is a structure diagram of the washing machine of the present disclosure.
Figure 2:
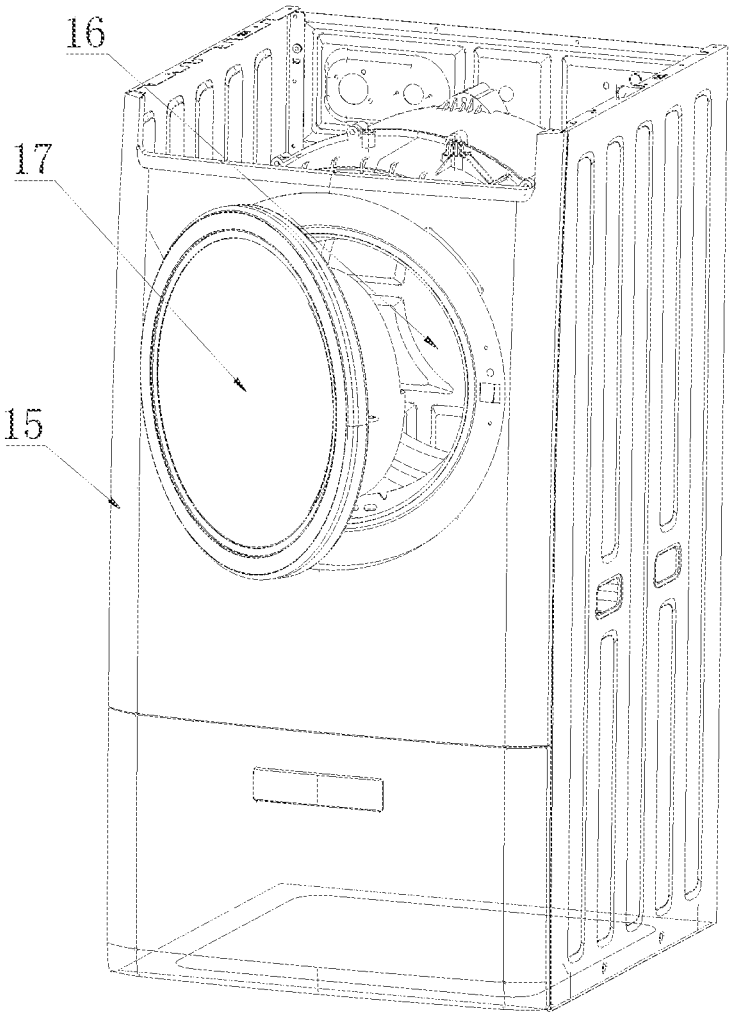
FIG. 2 is a structure diagram of the washing machine which the inner door is open together with the outer door of the present disclosure.
Figure 3:
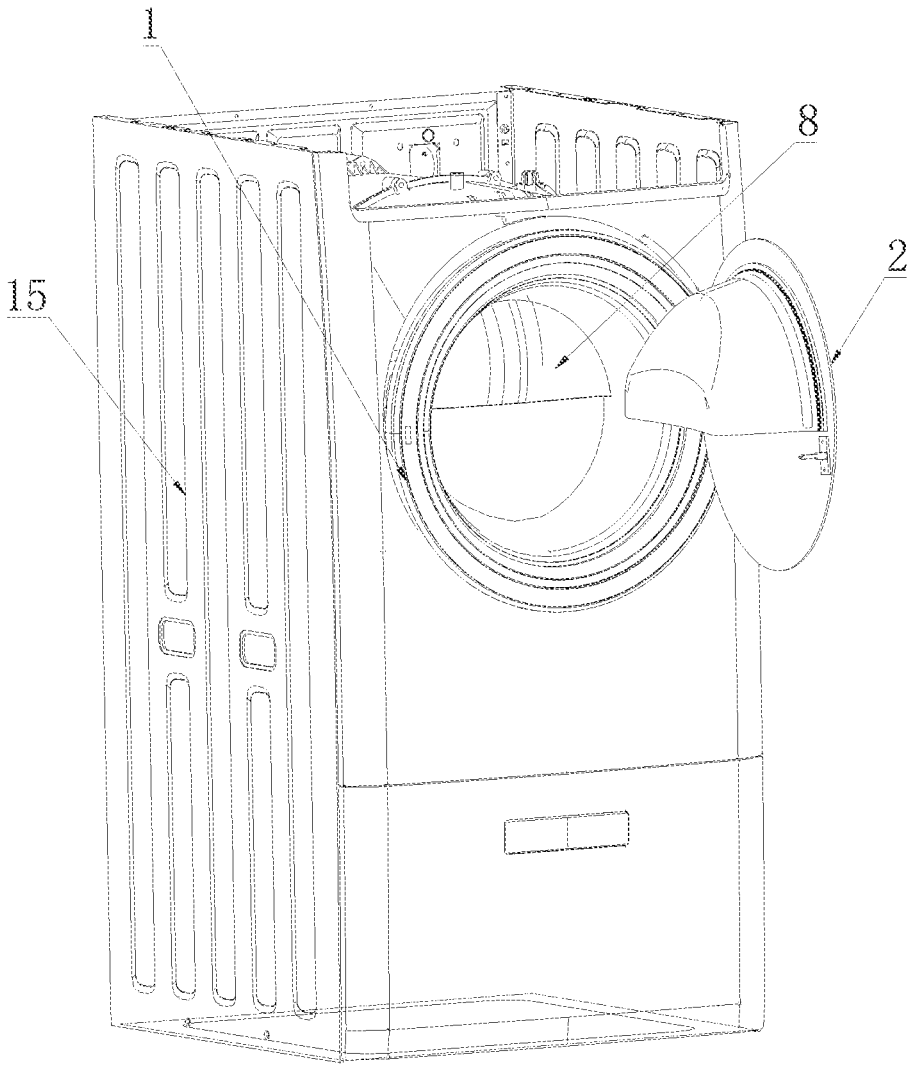
FIG. 3 is the structure diagram of the washing machine which the outer door is open the of the present disclosure.
Figure 4:
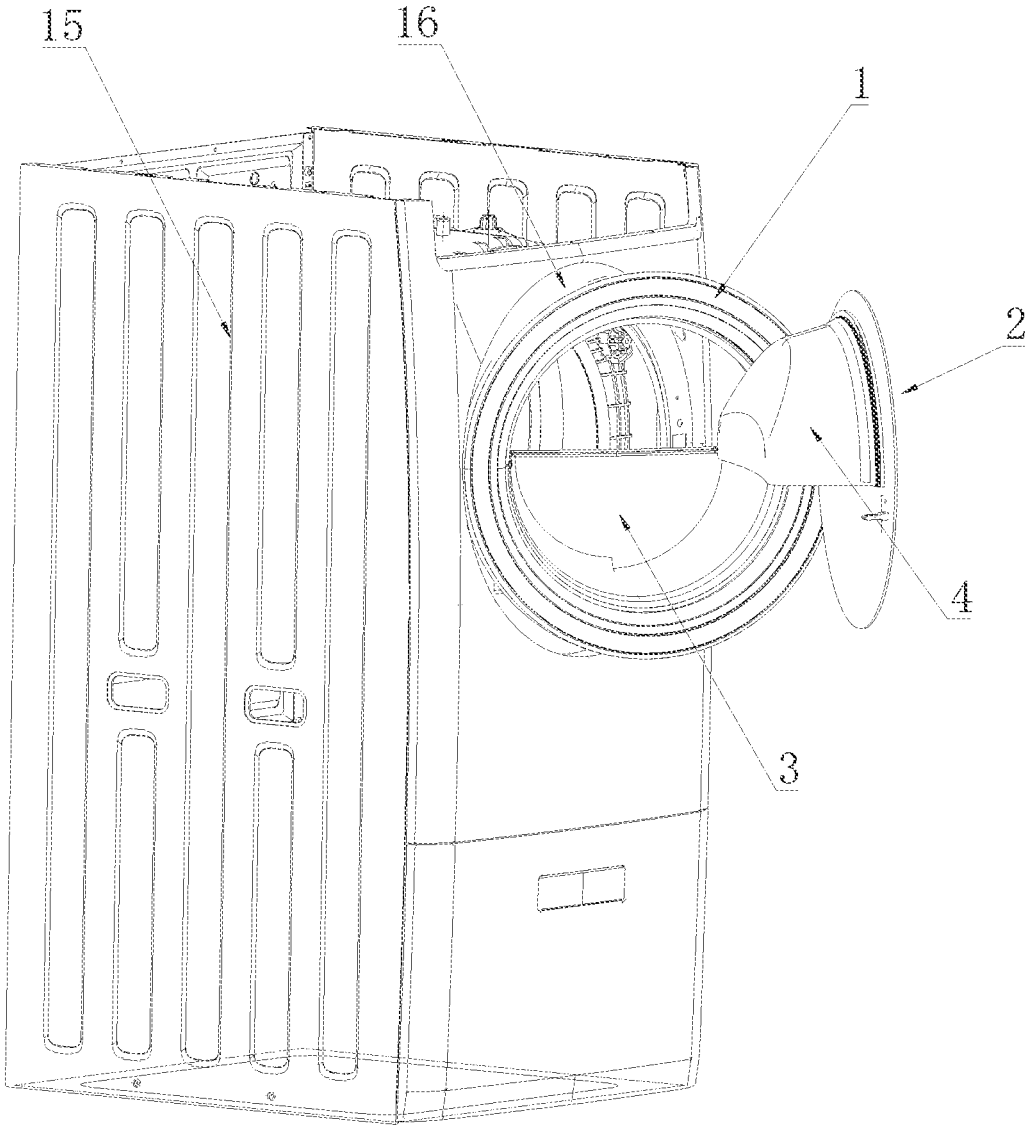
FIG. 4 is the structure diagram of the washing machine which the inner door and the outer door are open of the present disclosure.
Figure 5:
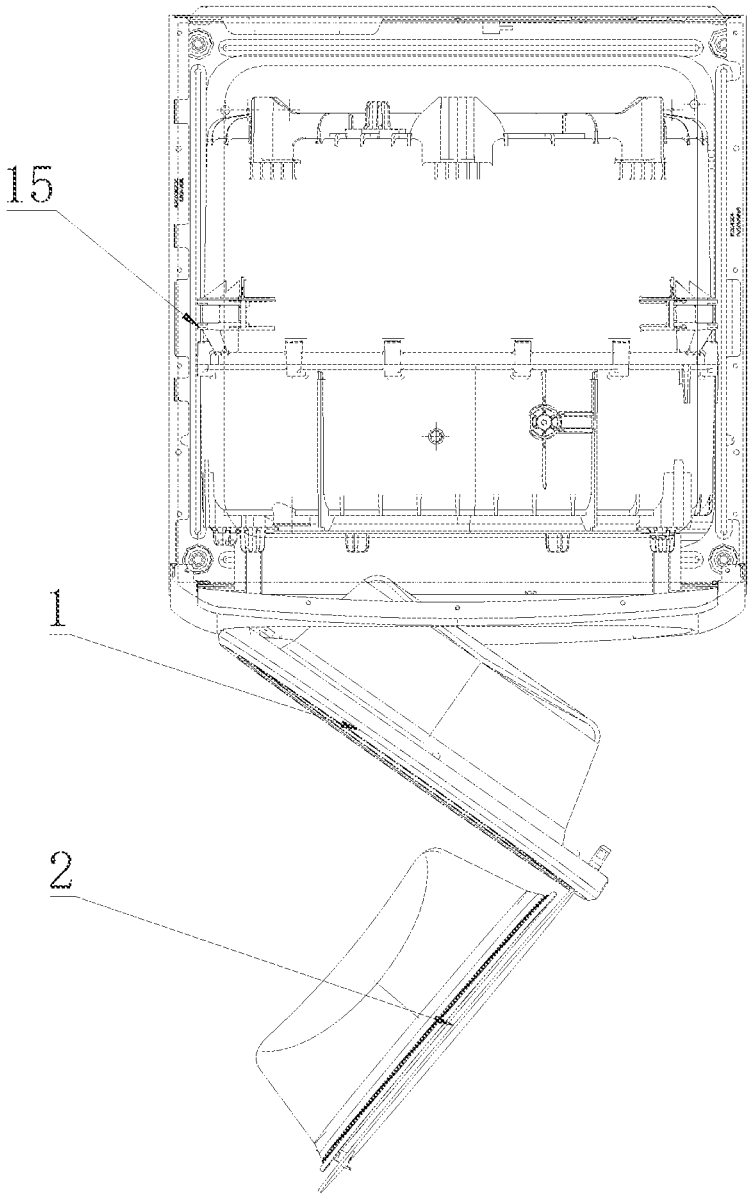
FIG. 5 is the top view of FIG. 4.

Wherein: 1—inner door, 2—outer door, 3—inner door glass window, 4—outer door glass window, 5—outer door lock, 6—inner door inner frame, 7—inner door outer frame, 8—opening, 9—outer door inner frame, 10—outer door outer frame, 11—outer door window screen, 12—hermetic structure, 13—mounting seat, 14—sealing strip, 15—washing machine, 16—front opening, 17—door, 18—inner door lock.

DETAILED DESCRIPTION

FIG. 1 to FIG. 5 show a drum washing machine according to the present disclosure. A door 17 is installed at a front opening 16 of a washing machine 15, and one side of the door 17 is hinged with a case of the washing machine 15. The door 17 is an inner and outer double-layer structure, including an inner door 1 and an outer door 2. An inner side of the inner door 1 is hinged with the case of the washing machine to partially open/close the front opening 16 of the case. An opening 8 is provided at an upper part of the inner door 1, and inner side of the outer door 2 is hinged with the inner door 1 to open/close the opening 8 on the inner door. The inner door 1 and the outer door 2 cooperate to open/close the whole front opening 16 of the case.

The door 17 comprises the inner door 1 and the outer door 2. The inner side of the inner door 1 is hinged with the case of the washing machine, while an outer side of the inner door 1 is hinged with the outer door 2. An inner door glass window 3 is provided at lower part of an inner door 1, and an opening is provided at an inner door upper part. An outer door glass window 4 is provided at the upper part of the outer door 2 to open/close the opening at the upper part of the inner door. The inner door glass window 3 and the outer door glass window 4 cooperate to form an observation window. When opening the inner door 1, the front opening of the washing machine is fully open. When opening the outer door 2, as the inner door 1 is connected to the washing machine, the opening at the upper part of the inner door 1 is open. Normally, the user can open the inner door to pick/place laundry from/inside the washing machine. If the user wants to add laundry or detergent to the washing machine during the washing process, the water inside the washing machine did not need to be completely discharged before the door is open. Just open the outer door and add laundry or detergent to the washing machine through the opening at the upper part of the inner door. Moreover, the inner door and the outer door are connected with each other in a reliable manner. Observed from the outside, the door is a whole unit, which gives the user a good overall feeling.

A door lock structure is arranged between the inner door 1 and the outer door 2, and the door lock structure can lock the outer door and the inner door into one part. When the outer door and the inner door are locked together, as the existing washing machine, after opening the inner door, the front opening of the washing machine will be completely open and the laundry can be taken in or taken out of the washing machine. Preferably, an outer door lock 5 is provided on the inner side of the outer door 2, and the outer door lock 5 can lock the outer door 2 to the inner door 1.

Figure 6:
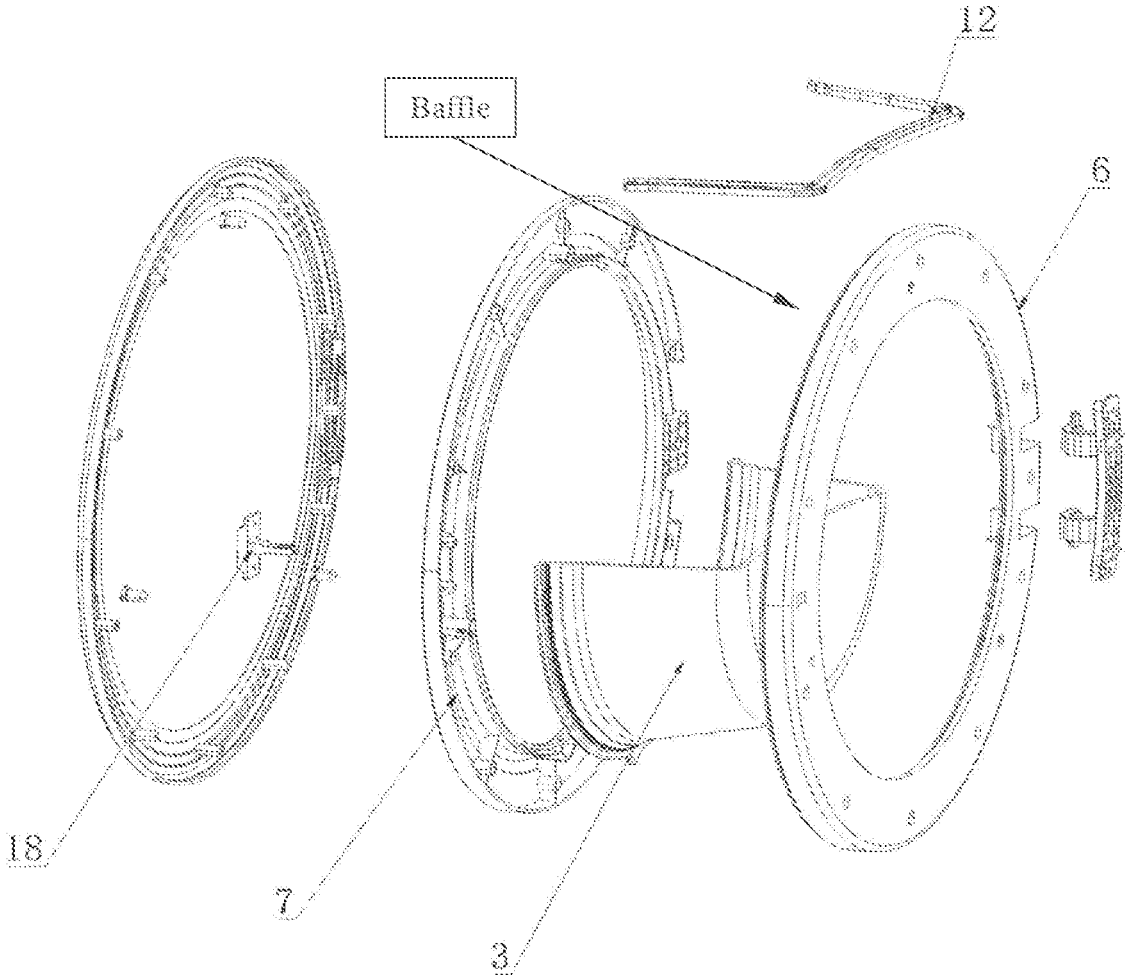
FIG. 6 is the structure diagram of the inner door of the present disclosure.

As shown in FIG. 6, the inner door 1 comprises an inner door inner frame 6, an inner door outer frame 7 and an inner door glass window 3. The inner door inner frame 6 and the inner door outer frame 7 are annular frames. The inner door glass window 3 at least covers the lower part of the area enclosed by an inner ring of the inner door inner frame 6 and the inner door outer frame 7. The upper part of the enclosed area is the opening 8. The inner door glass window 3 is disposed between the inner door inner frame 6 and the inner door outer frame 7. The inner door inner frame 6 and the inner door outer frame 7 are snapped together, or the inner door inner frame 6 and the inner door outer frame 7 are clamped together by a bolt. Then an edge of the inner door glass window 3 is sandwiched between the inner door inner frame and the inner door outer frame to achieve a fixed connection of the three. The inner door inner frame is hinged with the case of the washing machine. The inner door lock 18 is provided on the other side of the hinge joint, and the inner door lock is located on the inner door inner frame. The inner door lock 18 locks the inner door on the case of the washing machine.

The outer outline of the inner door glass window 3 is semi-circular, and the middle part protrudes towards the case. A turnup is provided at the edge of the lower arc section. The turnup is clamped between the inner door inner frame and the inner door outer frame. The top of the inner door glass window is a "[" shape turnup. The inner door glass window 3 is a side surface of a semi-circular transparent basin without a flat surface. A turnup is provided at the end of the side surface of the arc section, and the turnup is clamped between the inner door inner frame and the inner door outer frame, achieving fixation. After the removal of the flat surface, the remaining surface is a "[" shaped turnup, which facilitates the placement of a hermetic structure 12 on it.

Figure 7:
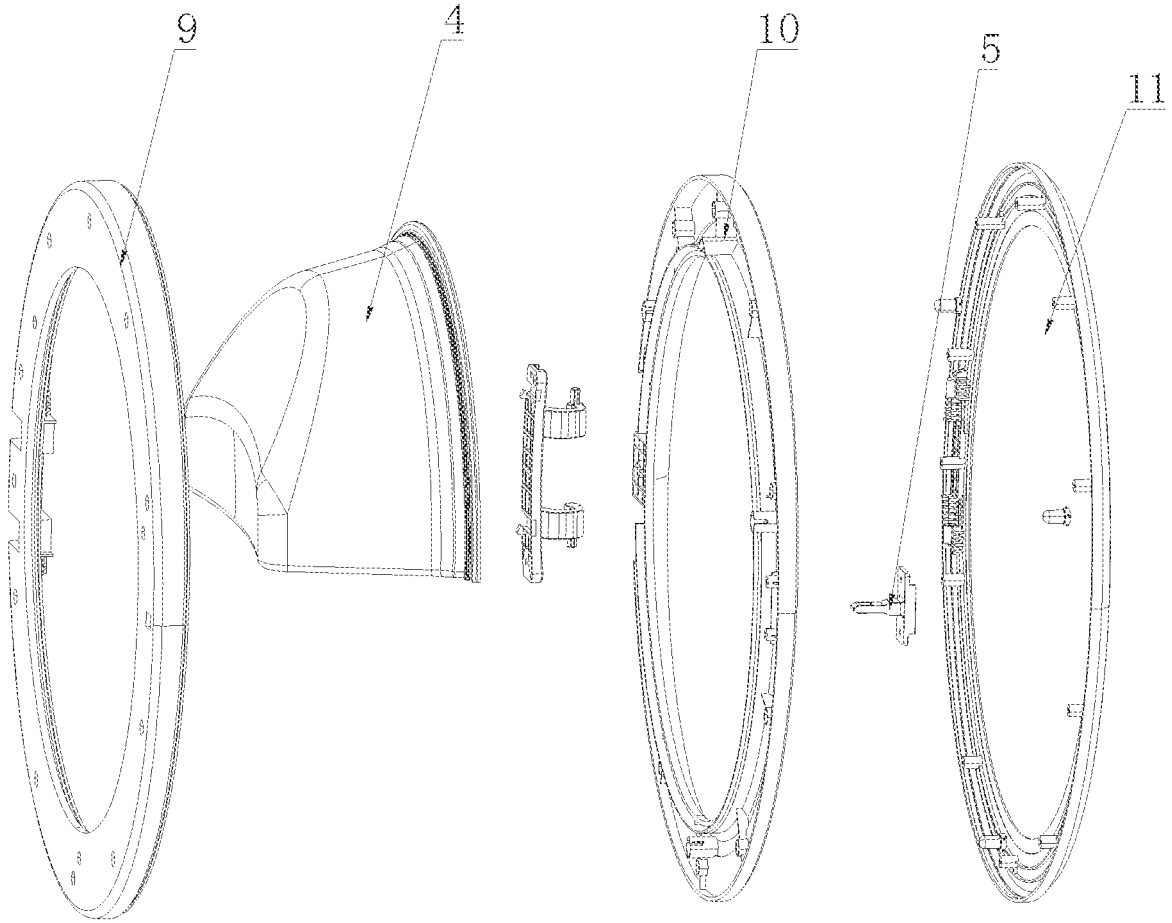
FIG. 7 is the structure diagram of the outer door of the present disclosure.

As shown in FIG. 7, the outer door 2 comprises outer door inner frame 9, outer door outer frame 10, and outer door glass window 4. The outer door inner frame 9 and the outer door outer frame 10 are annular frames, and the outer door glass window 4 covers the upper part of the area enclosed by an inner ring of the outer door inner frame 9 and the outer door outer frame 10. The outer door glass window 4 is disposed between the outer door inner frame 9 and outer door outer frame 10. The outer door inner frame 9 and the outer door outer frame 10 are snapped together, or the outer door inner frame 9 and the outer door outer frame 10 are clamped together by a bolt. Then an edge of the outer door glass window 4 is clamped between the outer door inner frame and the outer door outer frame to achieve a fixed connection of the three. Preferably, the outer door also comprises an outer door window screen 11. The outer door window screen 11 is arranged at the outer side of the outer door, and it is connected with the outer door glass window. The outer door window screen 11 covers the outer door glass window 4 and the inner door glass window 3. The outer door glass window is a semi-circular transparent basin, and the end part is provided with a semi-circular opening. The opening faces the outer door outer frame 10 or the outer door window screen 11, and a turnup is provided at the edge of the lower arc section. The turnup is clamped between the outer door inner frame and the outer door outer frame. The outer door glass window seals the inner door uper part opening. Meanwhile, the outer door window screen is capable of sealing the outer opening of the outer door window glass and the outer opening of the inner door glass window.

Figure 8:
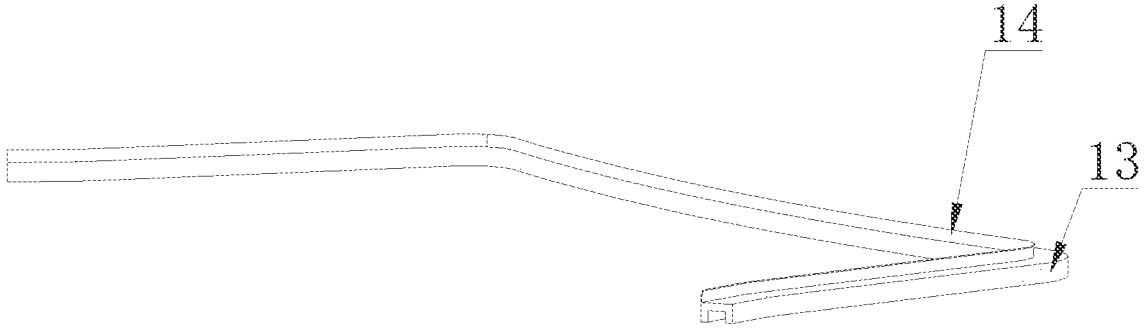
FIG. 8 is the structure diagram of the hermetic structure of the present disclosure.

As shown in FIG. 6 and FIG. 8, a sealing ring is arranged between the inner door inner frame 6 and the case of the washing machine, and another sealing ring is arranged between outer door inner frame and inner door outer frame. The hermetic structure 12 is arranged between the inner door glass window 3 and the outer door glass window 4. The hermetic structure 12 is provided at the turnup of the upper part of the inner door glass window 3. The hermetic structure comprises a grooving type mounting seat 13 wrapping the turnup of the upper part of the inner door glass window, and an elastic sealing strip 14 at the upper part of the mounting seat 13 forming an angle with the top surface of the mounting seat. The hermetic structure is a strip-shaped structure corresponding to the upper part of the inner door glass window. The mounting seat 13 is grooving type, and covers the turnup of the upper part of the inner door glass window. The sealing strip 14 is integrally installed with the mounting seat 13, as a soft sealing strip. The sealing strip forms an angle with the top surface of the mounting seat, preferably the angle is perpendicular. When the outer door is closed, the outer door glass window moves inwards. After the outer door glass window reaches the sealing strip, the sealing strip is overturned. When the outer door is completely closed, the sealing strip is squeezed between the outer door glass window and the mounting seat to form a seal. After the outer door is open, the sealing strip is restored to its original position. The mounting seat is made of a hard material, and the sealing strip is made of a softer material. As the mounting seat and the sealing strip are integrally formed, the soft and hard co-extrusion technology or the secondary molding technology may be used for processing.

A baffle is set between the inner door inner frame 6 and the inner door outer frame 7, corresponding to the inner door glass window. The baffle and a protruded part of the inner door glass window form an accommodation chamber. The baffle is a transparent structure. After the outer door is open, clothes, detergents, and etc. can be placed to fully utilize the space at the inner door glass window.

Preferably, the inner door glass window 3 is larger than a semi-circular surface, and the outer door glass window 4 is smaller than a semi-circular surface. The inner door opening only needs to be big enough for adding a single piece of clothing, avoiding splashing as the outer door is open.

A hinge of the inner door and the case is located at one side of the case, and a hinge of the inner door and the outer door is at the other side of the case, as the inner door with the outer door can be open to the left, and the outer door can be open to the right. Or the hinge of the inner door and the case and the hinge of the inner door and the outer door are at the same side of the case, as the inner door with the outer door can be open to the left, and the outer door can be open to the left. Or the hinge of the inner door and the case is at one side of the case and the hinge of the inner door and the outer door is at the lower side of the case, as the inner door with the outer door can be open to the left, and the outer door can be open downwards. It provides a variety of ways to open the door.

The above descriptions are merely preferred embodiments of the present disclosure, and it should be pointed out that those skilled in the art can also make various variations and improvements without departing from the principle of the present disclosure. This should also be regarded as in the protection scope of the present disclosure.

The invention claimed is:

1. A drum washing machine, comprising:

a door arranged at a front opening of the drum washing machine, and one side of the door being hinged with a case of the washing machine, wherein, the door is an inner and outer double-layer structure, which includes an inner door and an outer door, the inner door is hinged with the case of the washing machine to partially open, or close the front opening of the case, an opening is provided at an upper part of the inner door, the outer door is hinged with the inner door to open or close the opening at the upper part of the inner door, and the inner door and the outer door cooperate to fully open or close the front opening of the case;

an inner door glass window is provided at a lower part of the inner door, and the opening is provided at the upper part of the inner door;

an outer door glass window is provided at an upper part of the outer door to open or close the opening at the upper part of the inner door, the inner door glass window and the outer door glass window cooperate to form an observation window; and an outer door window screen provided on an outer side of the outer door wherein the outer door window screen is connected with the outer door glass window to cover the outer door glass window and the inner door glass window.

2. The drum washing machine according to claim 1, comprising:

a door lock structure arranged between the inner door and the outer door, and the door lock structure locks the outer door and the inner door into one part.

3. The drum washing machine according to claim 1, wherein, the inner door includes an inner door inner frame and an inner door outer frame, the inner frame and the outer frame are annular frames, and the inner door glass window at least covers a lower part of an area enclosed by an inner ring of the inner door inner frame and the inner door outer frame, and the upper part of the area enclosed is an opening.

4. The drum washing machine according to claim 3, wherein, a door lock structure is arranged between the inner door and the outer door, and the door lock structure locks the outer door and the inner door into one part.

5. The drum washing machine according to claim 3, wherein, an outer outline of the inner door glass window is semi-circular, and a middle part of the inner door glass window protrudes towards the case, a turnup is provided at an edge of a lower arc section, and the turnup is clamped between the inner door inner frame and the inner door outer frame.

6. The drum washing machine according to claim 3, comprising:

a baffle set between the inner door inner frame and the inner door outer frame, corresponding to the inner door glass window;

the baffle and a protruded part of the inner door glass window form an accommodation chamber.

7. The drum washing machine according to claim 1, wherein, the outer door includes an outer door inner frame and an outer door outer frame, the outer door inner frame and the outer door outer frame are annular frames, and the outer door glass window covers an upper part of an area enclosed by an inner ring of the outer door inner frame and the outer door outer frame.

8. The drum washing machine according to claim 7, wherein, the outer door glass window is a semi-circular transparent basin, and an end part of the outer door glass window is provided with a semi-circular opening, the semi-circular opening faces the outer door outer frame or the outer door window screen, a turnup is provided at the edge of a lower arc section, and the turnup is clamped between the outer door inner frame and the outer door outer frame and the outer door window screen and the outer door outer frame are connected.

9. The drum washing machine according to claim 1, comprising:

a hermetic structure is provided at a turnup of an upper part of the inner door glass window, the hermetic structure including a groove type mounting seat wrapping the turnup of the upper part of the inner door glass window, and an elastic sealing strip at an upper part of the mounting seat, forming an angle with a top surface of the mounting seat.

10. The drum washing machine according to claim 1, comprising:

a baffle set between the inner door inner frame and the inner door outer frame, corresponding to the inner door glass window;

the baffle and a protruded part of the inner door glass window form an accommodation chamber.

11. The drum washing machine according to claim 1, wherein, the inner door glass window covers more than half of an opening of the inner door, and the outer door glass window covers less than half of an opening of the outer door.

12. The drum washing machine according to claim 1, comprising:

a first hinge between the inner door and the case; and a second hinge between the inner door and the outer door wherein, the first hinge is located at one side of the case, and the second hinge is located at another side of the case;

or the first hinge and the second hinge are at the same side of the case;

or the first hinge is at one side of the case, and the second hinge is at a lower side of the case.

* * * * *